United States Patent [19]

Grandori

[11] 3,967,463

[45] July 6, 1976

[54] CONTINUOUS TUNNEL BORING MACHINE AND METHOD

[75] Inventor: Carlo Grandori, Rome, Italy

[73] Assignee: The Robbins Company, Seattle, Wash.

[22] Filed: Aug. 5, 1974

[21] Appl. No.: 494,390

[52] U.S. Cl. ..... 61/85; 299/33

[51] Int. Cl.[2] ..... E01G 3/02

[58] Field of Search ..... 61/85, 84, 42; 299/32, 299/33, 56

[56] References Cited

UNITED STATES PATENTS

| | | | |
|---|---|---|---|
| 2,111,405 | 3/1938 | Parker | 61/84 |
| 2,425,169 | 8/1947 | Wilson | 61/85 |
| 3,266,257 | 8/1966 | Larrouze et al. | 61/85 |
| 3,306,055 | 2/1967 | Tabor | 61/85 |
| 3,411,826 | 11/1968 | Wallers et al. | 61/85 X |

*Primary Examiner*—Dennis L. Taylor

*Attorney, Agent, or Firm*—Graybeal, Barnard, Uhlir & Hughes

[57] ABSTRACT

Front and rear shields are telescopically joined together. The front shield carries a power driven rotary cutterhead means. Main thrust rams are provided between the two shields for pushing the forward shield forwardly relative to the rear shield while the cutterhead means is being operated to mine the tunnel face, and also to pull the rear shield forwardly relative to the front shield. The rear shield includes a gripper assembly for reacting thrust and torque and a plurality of groups of auxiliary thrust rams which extend rearwardly from the rear shield to contact forward end portions of a tunnel lining which is erected under cover of a tail section of the rear shield. The auxiliary thrust rams are extendable a distance that is at least slightly larger than the axial length of one ring of tunnel lining segments. The main thrust rams are extendable a distance that is slightly larger than $1x$ of the stroke of the auxiliary thrust rams, where $x$ is the number of groups of auxiliary thrust rams. Each group of auxiliary thrust rams is offset from an adjacent group an amount equal to the stroke of the main thrust rams.

5 Claims, 9 Drawing Figures

CONTINUOUS TUNNEL BORING MACHINE AND METHOD

This application has a companion application which is in part directed to features which are disclosed but not claimed herein. The companion application bears Ser. No. 481,393, entitled Tunnel Boring Machine & Method, was filed on June 20, 1974, by Richard J. Robbins and David T. Cass, and has also been assigned to The Robbins Company.

BACKGROUND OF THE INVENTION

1. Field of the Invention

This invention relates to tunnel boring machines, and more particular to the provision of a continuous tunnel boring machine that is adapted to bore through a variety of geological materials, ranging from self-supporting ground to that requiring continuous lining support, and to a continuous boring method.

2. Description of the Prior Art

A known form of machine designed for boring through geological material which is self-supporting is disclosed by U.S. Pat. No. 3,203,737, granted Aug. 31, 1965 to Richard J. Robbins, Douglas F. Winberg and John Galgoczy. This type of machine includes a gripper assembly comprising mechanism which is extendable laterally of the tunnel into anchoring engagement with both sidewall portions of the tunnel. Hydraulic cylinders extend forwardly from the gripper assembly to a frame which supports a power driven cutterhead. These cylinders react rearwardly against the gripper assembly and when they are extended serve to push the frame and the cutterhead carried thereby forwardly in the tunnel. At the end of the stroke the gripper assembly is retracted from the tunnel wall and is pulled forwardly by the cylinders into a new position. It is then extended laterally to take a new grip on the tunnel wall and the process is repeated.

It is also known to tunnel through ground which requires continuous lining support by means of a shield type tunneling machine. Example of a shield type tunneling machine is disclosed by U.S. Pat. No. 3,266,257, granted Aug. 16, 1966 to Raymond J. L. Larrouze, Pierre F. Gesta, Pierre J. M. Goussault, Douglas F. Winberg and Richard J. Robbins. This type of machine includes a tubular body or shield having a rearwardly extending tail section. A sectional tunnel lining is constructed generally behind the machine, within the cover afforded by the tail section. The shield is advanced forwardly during the tunneling operation by the use of a plurality of hydraulic cylinders which are extendable rearwardly from the shield to react against the forward portion of the tunnel lining.

U.S. Pat. No. 3,523,426, granted Aug. 11, 1970, to Ernest Lauber discloses a tunneling apparatus for forming a tunnel through rock having zones differing in stability. According to this patent the tunneling machine (a shield type machine) is used to excavate material. Then, the machine is retracted. Next, a ring of tunnel lining segments is installed in the tunnel forwardly of the machine. Then, the machine is advanced an additional amount. Next, the machine is retracted and another ring of tunnel lining segments is installed. This procedure is repeated until the machine has moved through a zone of soft or unstable material.

U.S. Pat. No. 3,411,826, granted Nov. 19, 1968, to Richard A. Wallers and John C. Haspert, also discloses a tunnel boring machine which is adapted for boring through both self-supporting ground and ground that requires continuous lining support. It is basically a shield type machine and includes thrust rams which are extendable rearwardly to react against the tunnel lining for shoving the machine forwardly during tunneling through ground requiring a lining. However, the machine is also equipped with an accessory device in the form of a radially expandable ring. When the machine is used for boring through self-supporting ground the ring is installed in the tunnel behind the shield. It is expanded radially for the purpose of tightly gripping the tunnel wall, for the purpose of anchoring it in place in the tunnel. Then, the thrust cylinders are extended rearwardly to react against the anchored ring for moving the machine forwardly in the tunnel relative to such ring.

U.S. Pat. Nos. 3,613,379 and 3,613,384, granted on Oct. 19, 1971, to J. Donovan Jacobs, each discloses a multi-section shield type tunneling machine. The sections are telescopically joined and are each moved in the tunnel relative to the next by means of hydraulic thrust cylinders which may be interconnected between adjacent sections. Also, at least some of the sections are expandable radially to grip the tunnel wall, or carry radially extendable gripper shoes for gripping the tunnel wall. According to these patents, a continuous concrete lining is formed in the tunnel rearwardly of the machine.

An early form of shield tunneling machine is disclosed by U.S. Pat. No. 1,292,159, granted on Jan. 21, 1919, to F. J. Trumpour. It includes inner and outer shields which normally are advanced together by a set of thrust rams which react rearwardly against the forward end of the tunnel lining. When hard material is contacted the outer shield is still moved forwardly by the thrust rams. The inner shield, which carries power operated cutter elements, is then moved forwardly at a different rate by additional thrust rams which react rearwardly against the outer shield.

SUMMARY OF THE INVENTION

Tunneling machines to which the present invention relates are of the shield type. They comprise a pair of front and rear shields. The front shield may be provided with a rotary cutterhead having cutter elements which dislodge material from the tunnel face, or may include another type of power earth cutting equipment or merely work space for workmen. A plurality of thrust rams (e.g. double-acting hydraulic cylinders) are interconnected between the front and rear shields and are operable for shoving the front shield forwardly relative to the anchored rear shield, and for pulling the rear shield forwardly towards the front shield. The rear shield includes a rearwardly extending tail section under cover of which a sectional tunnel lining is constructed. Auxiliary thrust rams are carried by the rear shield. They are extendable rearwardly to contact and react against the forward end of the tunnel lining for reacting thrust.

According to the invention, the auxiliary thrust rams comprise plural groups (e.g. two) of circumferentially adjacent thrust rams. Each group occupies a peripheral zone and its thrust rams are extendable rearwardly in unison a distance at least slightly larger than the axial length of a tunnel lining segment. The main thrust rams are extendable rearwardly a distance substantially equal to vx of the stroke of the auxiliary thrust rams, where $x$ is the number of groups of auxiliary thrust rams. The groups of auxiliary thrust rams are progressively offset rearwardly an amount substantially equal to the stroke of the main thrust rams. By virtue of this arrangement, one group of the auxiliary thrust rams may be retracted and tunnel lining segments placed in the space vacated by them while the remaining groups are extended against a previously erected forward portion of the tunnel lining, and the main thrust rams are being used for moving the front shield relative to the rear shield. Following full extension of the main thrust rams such main thrust rams are retracted to pull the rear shield forwardly. At the same time the auxiliary thrust rams are extended for the purpose of holding the forward lining segments in place. In some installations it may be necessary to use the auxiliary thrust rams for advancing the rear shield. Following advancement of the rear shield the front shield is again advanced, by another extension of the main thrust rams.

After the segments are set into place rearwardly of the retracted first group of auxiliary thrust rams, such thrust rams are extended against such segments, and the next group of thrust rams are retracted.

The $1/x$ segment length stroke of the main cylinder results in a relatively short forward shield, making it possible to turn such shield through relatively sharp turns. This arrangement of the main thrust rams, the grouping and offsetting of the auxiliary thrust rams, and the segment length stroke of the auxiliary thrust rams, makes it possible to continuously construct the tunnel lining while operating the tunneling machine, including during advancement of the machine along relatively small radius curves.

These and other objects, features, advantages and characteristics of the present invention will be apparent from the following description of typical and therefore non-limitive embodiments thereof.

BRIEF DESCRIPTION OF THE DRAWING

In the drawing like letters and numerals refer to like parts, and.

DESCRIPTION OF THE PREFERRED EMBODIMENTS

Figure 1:
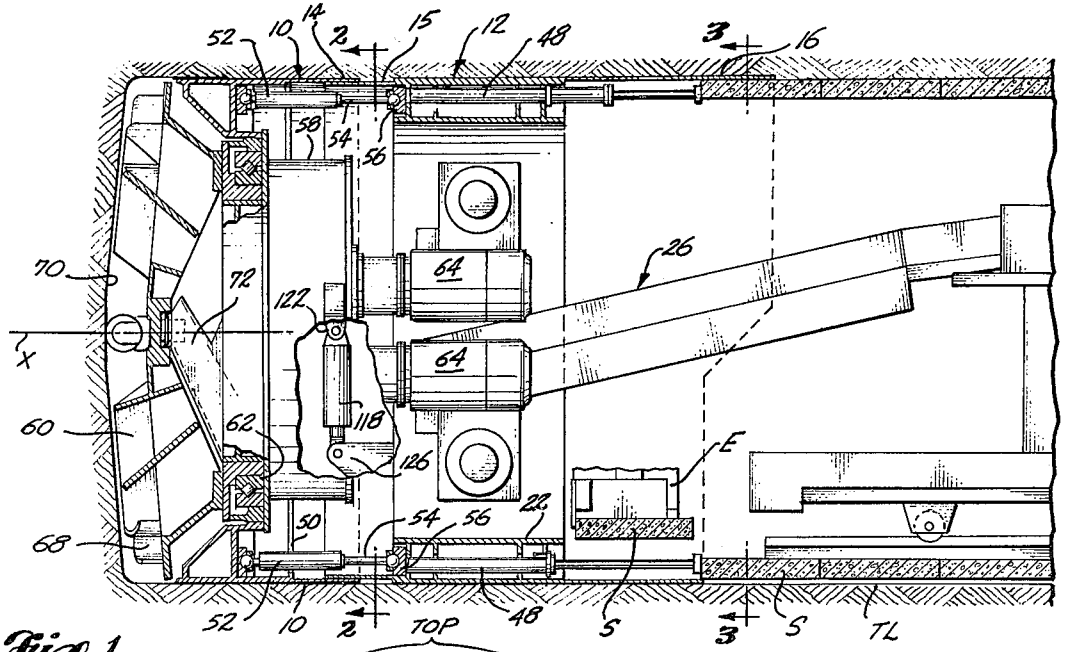
FIG. 1 is a longitudinal sectional view of an embodiment of the invention, with some parts in elevation.
Figure 2:
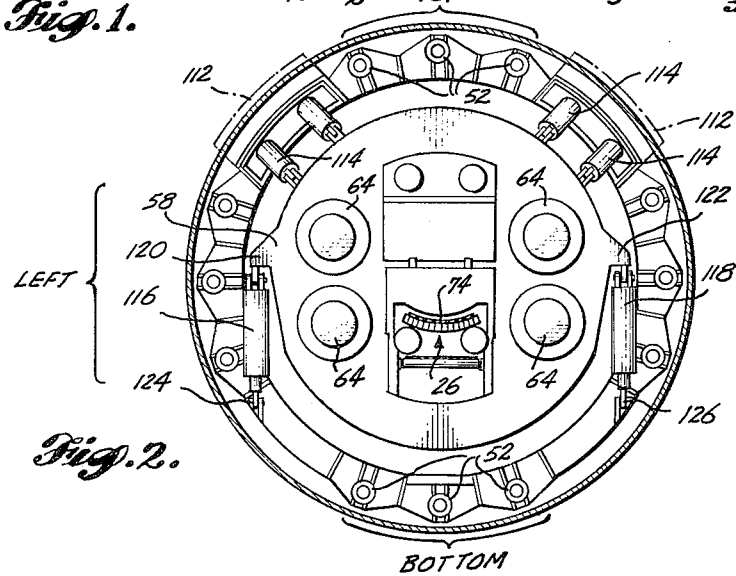
FIG. 2 is a cross-sectional view taken substantially along line 2—2 of FIG. 1.
Figure 5:
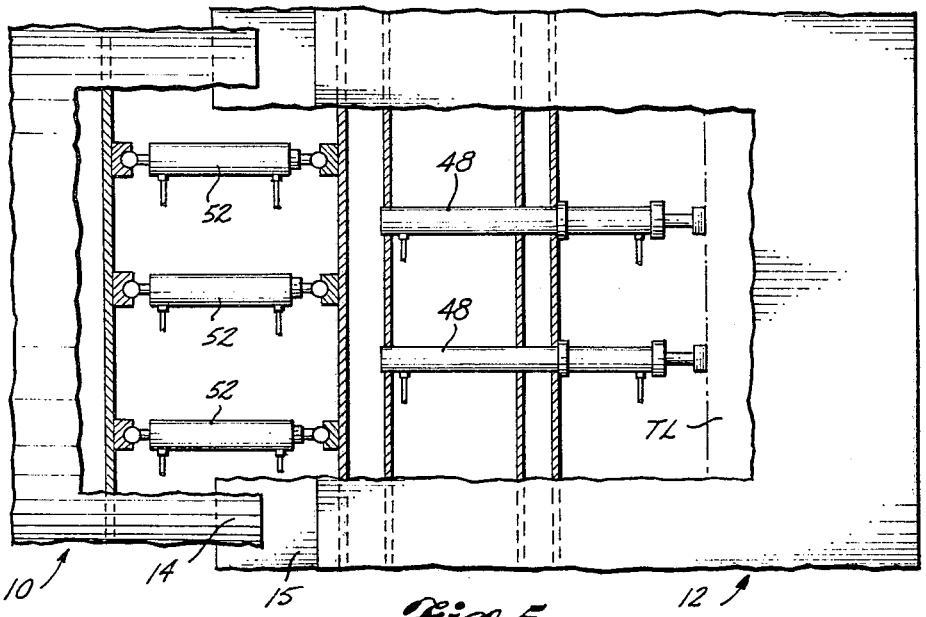
FIG. 5 is a fragmentary top plan view in the region of telescopic overlap of the two shields, with foreground portions of the shield skins cut away.

Referring to FIGS. 1 and 2, the embodiment of the invention shown by these figures comprises a pair of telescopically joined tubular front and rear shields 10, 12. The front shield 10 is shown to comprise a rear section 14 which overlaps the forward portion 15 of rear shield 12. Rear shield 12 includes an elongated rearwardly extending tail section 16 within which a sectional tunnel lining TL is constructed.

The rear shield 12 also includes gripper means for gripping the side wall of the tunnel for the purpose of anchoring the rear shield 12 in place to react thrust and torque. The gripper means may comprise a pair of radially extendable and retractable gripper shoes or pads 18, 19 (FIG. 3) which are extended and retracted by double-acting hydraulic cylinders 20. The rear shield 12 further includes a ring-like, radially shallow frame 22 which is contiguous the shield wall or skin. This frame 22 includes generally radial guideways 24 for the gripper shoes 18. The central portion of the frame 22 is open to provide room for a conveyor 26 and a segment erector E, and passage space for personnel.

Frame 22 also mounts a ring of axially disposed, rearly extendable thrust rams 48, hereinafter referred to as the auxiliary thrust rams. The rams 48 are extendable rearwardly to react against the forward segments S of the tunnel lining TL. Following such extension, the rams 48 are retracted to provide space forwardly of the last completed ring of the tunnel lining segments S in which new segments S can be placed by the segment erector E, as hereinafter described in detail.

The front shield 10 also comprises a ring-like open centered radially shallow frame 50. Frame 50 mounts a second ring of axially disposed, rearwardly extendable thrust rams 52, hereinafter referred to as the main thrust rams. The piston rods 54 of thrust rams 52 are extendable rearwardly to react against a radial wall portion 56 of the frame 22. The rams 52 are double-acting hydraulic cylinders. Piston rods 54 are connected to the frame wall 56 so that they can also be used to pull shield 12 forwardly.

Front shield 10 also carries a cutterhead support 58. A power earth cutting means, e.g. a rotary cutterhead 60, is mounted on said cutterhead support 58 by a large diameter bearing 62. A plurality of drive motors 64, are mounted on the cutterhead support 58. They drive small diameter drive gears (not shown) which mesh with a large diameter gear (not shown) on the cutterhead 60, in the usual manner. The cutterhead 60 carries a plurality of forwardly directed cutter elements, such as rolling disc type cutters for example. Material pickup buckets 68 are provided at the periphery of the cutterhead 60. These buckets serve to scoop up the material cut from the tunnel face 70 and deliver it into chutes in the cutterhead through which it flows into a hopper 72 positioned to discharge onto the conveyor belt or conveyor 26. Conveyor belt 74 carries the mined material rearwardly out of the tunnel or to some other means of transporting them out of the tunnel. This operation occurs while the front shield is being shoved forwardly.

Each shield 10, 12 supports itself by virtue of the fact that its lower portion rests directly on the floor of the tunnel.

A tunnel lining may not be necessary when the machine is used to bore a tunnel through hard material which is capable of supporting itself. In such case the rear set of thrust rams 48 are retracted and not used. The gripper shoes 18 are extended to grip the tunnel wall to in that manner anchor the rear shield 12 in place in the tunnel. The forward thrust rams 52 are extended for the purpose of shoving the front shield 10 forwardly relative to the anchored rear shield 12. The cutterhead 60 is rotated to mine the tunnel face 70 as the shield 10 is being moved forwardly. Following full extension of the thrust rams 52 the gripper feet 18 are retracted and the thrust rams 52 are used for pulling the rear shield forwardly relative to the front shield 10. After the thrust rams 52 are fully retracted, and the rear shield 12 is in its new position forwardly of its old position, the gripper feet 18 are again extended and the above described operation is repeated.

When the tunneling machine is used for boring through material which is not sufficiently self-supporting a tunnel lining TL is erected in the wake of the machine, within the cover provided by the tail section 16 of the rear shield 12. In relatively firm material of this type the gripper feet 18 are extended for the purpose of anchoring the rear shield 12 in the tunnel. The thrust cylinders 52 are used for pushing the front shield 10 forwardly relative to the anchored rear shield 12 while the cutterhead 60 is driven for the purpose of mining the tunnel face 70. Following full advancement of the forward shield 10 the gripper feet 18 are retracted and the thrust cylinders 52 are used for pulling the rear shield 12 forwardly into a new position. The rear thrust rams 48 may have to be used to aid forward movement of shield 12. In other words, the rear thrust rams 48 may be extended rearwardly to react against the forward segments S of the tunnel lining TL. Following extension of the thrust rams 48 the gripper feet 18 are again extended for the purpose of anchoring the rear shield 12 in place of the tunnel. Then, the front shield 10 is again pushed forwardly relative to the rear shield 12 by use of the thrust rams 52. At the same time the thrust rams 48 may be retracted so that additional tunnel lining segments S can be set in place while the front shield advances for the purpose of forming a new ring of segments S at the forward end of the tunnel lining TL.

In ground that is not firm enough to permit use of the gripper feet, forward advancement of the shield 12 is achieved by use of thrust rams 48 alone.

The gripper shoes 18 are extended and retracted by a pair of upper and lower double-acting hydraulic cylinders 80, 82. The upper motor 80 is interconnected between mounting ears 84, 86 at the upper ends of the gripper shoes 18, 19. In similar fashion, the lower fluid motor 82 is interconnected between mounting ears 88, 90 at the lower ends of the shoes 18, 19.

The sectional view (FIG. 3) of the lower motor 82 shows the internal make-up of both motors 80, 82. Each motor 80, 82 comprises a piston 92 having a piston head 94 which is received within a piston chamber 96 having a closed inward end 98 and a closed outward end 100. A first variable volume fluid chamber 102 is formed between piston head 94 and chamber wall 98. A first conduit 104 serves to both deliver fluid into and exhaust fluid out from the chamber 102. A second chamber 106 is formed between head 94 and chamber wall 100. A second conduit 100 is provided for both delivering fluid into and removing it from the chamber 106. The two cylinders 80, 82 are operated together. That is, when it is desired to extend the gripper shoes 18, 19, motive fluid is introduced into the chambers 102 of both cylinders 80, 82 and at the same time is exhausted from the chambers 106 of both cylinders 80, 82. The direction of fluid movement is reversed when it is desired to retract the gripper shoes 18, 19.

Figure 4:
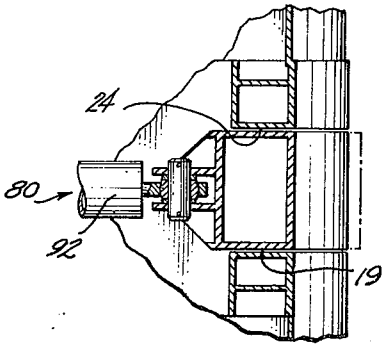
FIG. 4 is a fragmentary sectional view taken substantially along line 4—4 of FIG. 3.
Figure 3:
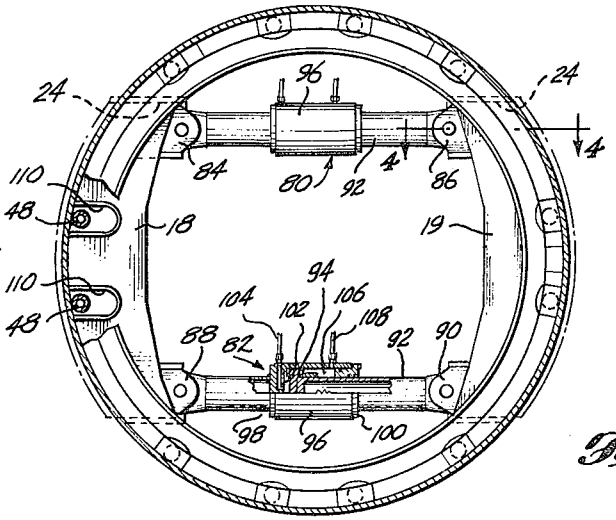
FIG. 3 is a cross-sectional view taken substantially along line 3—3 of FIG. 1, with some parts omitted.

As best shown by FIG. 3, the side located auxiliary thrust rams 48 pass laterally through the guideways 24 for the gripper shoes 18, 19. In order to prevent interference with the gripper foot movement by the rams 48, slots 110 are provided in the gripper feet or shoes 18, 19. These slots 110 are elongated in a direction parallel with the direction of extent of the cylinders 18, 19. Such slots 110 are long enough to accommodate the amount of gripper shoe movement that is involved. In FIG. 3 the conveyor and other relatively central positioned components are omitted for the sake of clarity.

A ball and socket joint or the like is provided at each end of each cylinder 52 between such end and its support structure.

The cutterhead 60 is slightly larger in diameter than the shields 10, 12. This is so that the cutterhead 60 will cut a circle that is slightly larger in diameter than the shields 10, 12. The lower boundary of the tunnel generally coincides with the lowermost surfaces of the shields 10, 12. Thus, a radial gap exists above the shields 10, 12 because of this difference in diameters. This radial space or gap is commonly termed an "overcut". The upper portion of the forward shield 80 carries a pair of stabilizer shoes 112 which move generally radially in-and-out through guideways formed in a frame portion of the shield 10. The shoes 112 are extended and retracted by double-acting hydraulic cylinders 114. One purpose of the shoes 112 is to provide a means which can be extended generally radially outwardly from the shield frame to contact and slide along upper side portions of the tunnel, to provide stabilizing contact as needed at such locations.

The pads 112 may also be extended for the purpose of gripping the tunnel wall for the purpose of helping to anchor the forward shield 10 in place while the rear shield 12 is being advanced forwardly. In some installations it is believed that the weight of the forward shield 10 alone will be sufficient to anchor it in place while the rear shield 12 is being advanced. Of course, at times when the rear thrust rams 48 are being used for propelling the rear shield 12 forwardly, anchoring of the forward shield 10 is unnecessary.

A pair of torque cylinders 116, 118 are provided on opposite sides of the machine, to serve as structural links for transmitting torque between the two shields 10, 12. In FIG. 1 a foreground portion of cutterhead support 58 is cut away in order to show the position of torque cylinder 118. In the illustrated embodiment the cutterhead support 58 is provided with rearwardly projecting mounting brackets 120, 122 at its two sides. The upper ends of the cylinders 116, 118 are pivotally connected to these brackets 120, 122 by a ball and socket joint or the like. The lower ends of the cylinders 116, 118 are similarly pivotally connected to brackets 124, 126 which are part of the rear shield 12.

Within each torque cylinder equal areas exist on the two sides of the piston head. The upper chamber above the piston head of torque cylinder 116 is connected with the lower chamber of the opposite side torque cylinder 118 by a fluid conduit. Also, the lower chamber of torque cylinder 116 is connected with the upper chamber of torque cylinder 118 by a fluid conduit.

When the two shields 10, 12 are telescopically together the two torque cylinders 116, 118 lean rearwardly from vertical. As the forward shield 10 is pushed forwardly the upper connection point moves axially forwardly. When the thrust rams 52 are fully extended the torque cylinders 116, 118 lean forwardly from vertical.

During drilling the cutterhead support 58 wants to rotate in the opposite direction from the cutterhead 60. This is because the torque applied to the cutterhead 60 for rotating it in one direction is also imposed in the opposite direction on cutterhead support 58, tending to rotate it in the opposite direction. During tunneling the rear shield 12 is anchored in place by virtue of the fact that the gripper feet 18, 19 are extended outwardly into gripping contact with the tunnel wall. The counter-rotational torque is transmitted by the torque cylinders 116, 118 from the cutterhead support 58 back into the rear shield 12 where actual rotation can be resisted by the gripping of the tunnel walls. The two torque cylinders work in conjunction. Counter-rotational torque tends to move the piston rod and piston head of cylinder 116 downwardly, applying pressure on the fluid in the lower chamber. The counter-rotational torque exerted on cutterhead support 58 also tends to lift the piston rod and piston head of the torque cylinder 118, applying pressure on the fluid in the upper chamber of torque cylinder 118.

Owing to the provision of equal areas on opposite sides of the pistons, the torque cylinders 116, 118 can change length as necessary during telescopic movement of the shields 10, 12. Movement tending to shorten the cylinders 116, 118 results in an increase in volume of each upper chamber and an equal change in volume in each lower chamber. Thus, during such movement fluid is merely transferred from each chamber lower into the upper chamber with which it is connected. In similar manner, movement tending to lengthen the cylinders 116, 118 causes a decrease in volume in the upper chambers and a corresponding equal increase in volume in the lower chambers. During such movement fluid is merely transferred from each upper chamber over to the lower chamber with which it is connected.

In the illustrated embodiment one-half of the auxiliary thrust rams 48 are located in the upper half of the rear shield 12 and the other half of such auxiliary thrust rams 48 are located in the lower half of the shield 12. By way of typical and therefore non-limitive example, the upper auxiliary thrust rams 48 are offset rearwardly from the lower thrust rams 48 an amount substantially equal to the stroke of the main thrust cylinders 52. All of the auxiliary thrust rams 48 are extendable an amount that is at least slightly larger than the axial length of the tunnel lining segments S.

Figure 6:
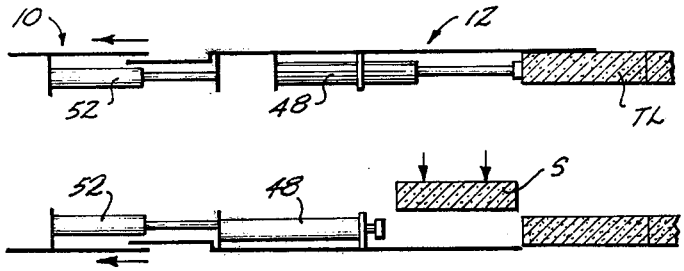
FIG. 6 is a diagrammatical longitudinal sectional view showing the machine parts in the position of FIG. 1, but with the lower group of auxiliary thrust rams retracted.
Figure 7:
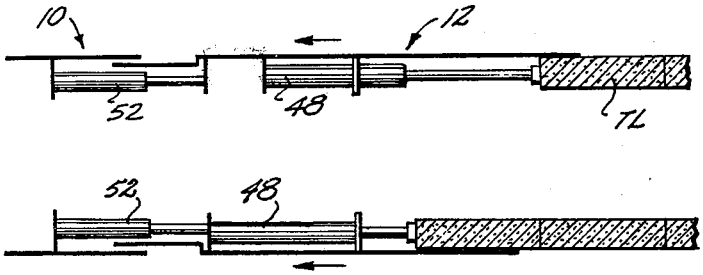
FIG. 7 is a view like FIG. 6, but with the rearward shield advanced.
Figure 8:
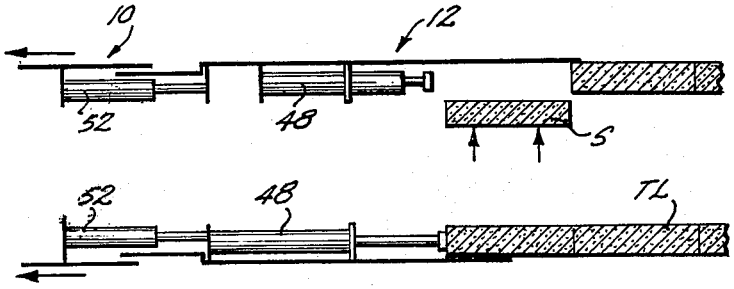
FIG. 8 is a view like FIG. 7 but with the forward shield advancing, the lower group of auxiliary thrust rams extended, and the upper group of thrust rams retracted.

Referring to FIGS. 1 and 6 – 8, an advancement sequence of the machine will now be described. Let it be assumed that the machine is initialy in the positon shown by FIG. 1. The auxiliary thrust rams 48 are reacting against the forward end portion of the tunnel lining TL and the main thrust rams 52 are being operated for moving the forward shield 10 forwardly relative to the rear shield 12. As shown by FIG. 6, while this is being done the lower group of auxiliary thrust rams 48 may be retracted and the lower half of the tunnel lining segments S may be set into place within the space vacated by such thrust rams 48.

Following full extension of the main thrust rams 52, such main thrust rams are retracted and the rear shield 12 is advanced an amount equal to the stroke of the main thrust rams 52. Since the upper group of auxiliary thrust rams 48 are offset from the rear group in the manner described, such upper thrust rams 48 can be further extended to complete their stroke while still reacting against the forward end of the tunnel lining TL. Following forward movement of the rear shield 12 the main thrust rams 52 may again be extended for the purpose of further advancing the front shield 10. Placement of tunnel lining segments within the lower space can be completed while this is happening.

After the upper group of auxiliary thrust rams 48 have been fully extended, and the lower half of a new ring of tunnel lining segments S has been erected, the lower group of auxiliary thrust rams 48 may be extended against the lower half of the new ring and the upper group of auxiliary thrust rams 48 may be retracted, so that the upper half of the new ring can be erected. Of course, during erection of the crown half of the new tunnel lining ring the main thrust rams 52 are used in the previously described manner (i.e. in a two stroke manner) for advancing the forward shield 10.

By way of typical and therefore non-limitive example, the upper set of three forward thrust rams 52 and the lower set of three forward thrust rams 52 are coordinated in a manner to be described below for the purpose of steering the front shield 10 vertically (i.e. control pitch) relative to the rear shield 12. Similarly, the left and right sets of forward thrust rams 52 are coordinated for the purpose of steering the front shield 10 right or left relative to the rear shield 12 (i.e. yaw control). A sufficient amount of clearance exists between the tail section 14 and the forward extension 15 to accommodate the amount of angular movement that is involved.

Figure 9:
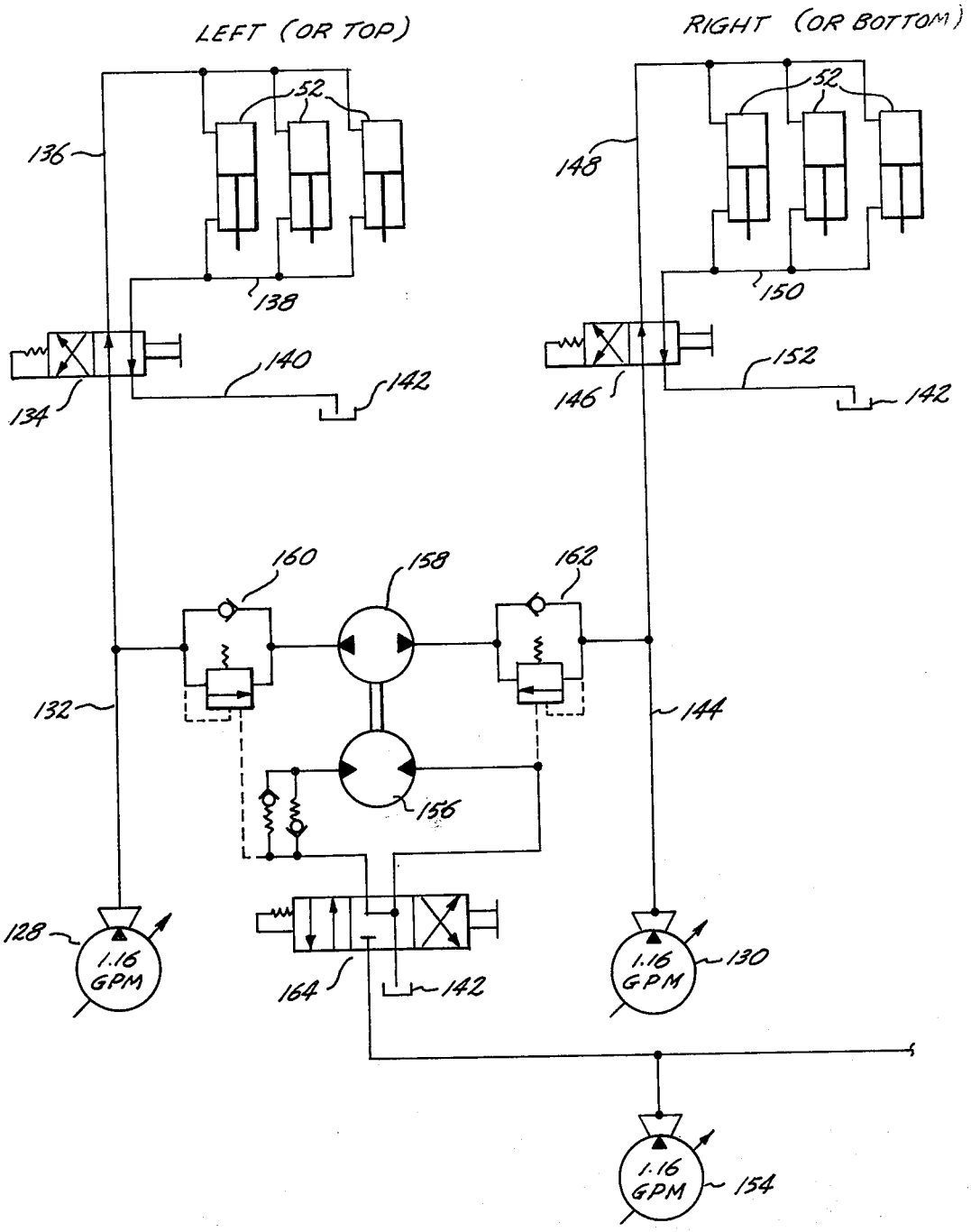
FIG. 9 is a schematic view of the fluid system for one diametrical opposite pair of forward thrust ram sets of an example steering system, the view also serving to illustrate the fluid system provided for the remaining pair of diametrically opposed thrust ram sets since the systems are essentially alike.

Referring to FIG. 9, a hydraulic pump 128 delivers hydraulic fluid to the set of three forward thrust rams 52 located on the left side of the machine. Another hydraulic pump 130 delivers hydraulic fluid to the three forward thrust rams 52 located on the right side of the machine. A delivery line 132 extends from pump 128 to a control valve 134. The forward chambers of forward thrust ram 52 are interconnected and all three forward chambers are connected to the valve 134 by a line 136. The rear chambers of forward thrust rams 52 are also interconnected and are all three connected to valves 134 by a line 138. A return line 140 extends from valve 134 ultimately back to the fluid reservoir 142. In similar fashion, a delivery line 144 extends from pump 130 to valve 146. The forward chambers of the right side three thrust rams 52 are interconnected and by a line 148 are all three connected to the valve 146. The rear chambers of the right three thrust rams 52 are also connected together and are all three connected to the valve 146 by a line 150. A return line 152 extends from valve 146 back to the reservoir 142.

Another pump 154 is provided for delivering fluid to a reversible hydraulic motor 156 which drives a reversible transfer pump 158. Transfer pump 158 is located between delivery lines 132, 144. Conventional holding valves 160, 162 are located between delivery lines 132 and pump 158 and between pump 158 and delivery line 144. A control valve 164 is located between pump 154 and motor 156.

During straight ahead travel of the tunneling machine, the pumps 128, 130 are operated for the purpose of delivering hydraulic fluid into the forward chambers of all of the thrust rams 52. The control valves 134, 146 are in the position shown by FIG. 9. Hydraulic fluid in the rear chambers of the thrust rams 52 flows out from such chambers into the lines 138, 150, then through the valves 134, 146, then through lines 140, 152, and ultimately back to the reservoir 142. Following extension of the thrust rams 52, the control valves 134, 146 are operated to reverse the flow to and from the cylinders 52, so that the cylinders 52 will be retracted and the rear shield 12 will be pulled forwardly towards the front shield 10.

When it is desired to steer the machine sideways, such as to the right, for example, the valve 164 is operated to deliver flow from pump 154 to the hydraulic motor 156 so that such motor 156 will drive reversible pump 158 in the direction causing a transfer of fluid from delivery line 144 into 132. As a result, hydraulic fluid will be delivered into the forward chambers of the left side thrust rams 52 at a faster rate than it is delivered into the right side set of thrust rams 52. The left side rams 52 will be extended a greater amount than the right side cylinders 52 and the forward shield 10 will turn to the right.

In the example the top three cylinders 52 are connected together in the manner illustrated and the bottom three cylinders are also connected together in the manner illustrated. During sideways turning of the machine fluid is delivered at substantially the same rate to both of these sets of cylinders 52. However, since the cylinders 52 of each set are interconnected the sideways turning movement of the front shield 10 results in an uneven distribution of fluid to both the upward three thrust cylinders 52 and the lower three thrust cylinder 52, so that these cylinders will not impede horizontal turning.

The front shield can be returned to a straight path, or can be moved to the left of a straight line path, by operation of valve 164 to reverse the direction of motor 156 and hence the direction of transfer of the motive fluid.

As previously mentioned, in the example the fluid system for the top and bottom sets of thrust cylinders 52 are essentially like the illustrated system for the left and right side thrust cylinders 52. The top and bottom cylinders 52 are operated in the manner described for the purpose of steering the front shield 10 vertically upwardly or downwardly relative to the rear shield 12. During vertical steering there is uneven distributions of fluid to both the three left side cylinders 52 and the three right side cylinders 52, so that these cylinders will not impede vertical turning.

From the foregoing, various other arrangements, modifications and adaptations of the present invention will occur to those skilled in the art to which the invention is addressed, within the scope of the following claims.

What is claimed is:

1. In a tunneling machine comprising end-to-end front and rear tubular shields, said rear shield including a tail section which extends rearwardly and provides space under cover within which a tunnel lining is constructed, main thrust ram means interconnected between the front and rear shields, for shoving the front shield forwardly relative to the rear shield and for steering said front shield relative to said rear shield; auxiliary thrust rams mounted on said rear shield and extendable rearwardly to contact the tunnel lining, the improvement comprising:

said auxiliary thrust ram means comprising a plurality of groups of thrust rams, with each such group comprising circumferentially adjacent thrust rams in a continuous peripheral zone of the rear shield, extendable rearwardly in unison a distance at least slightly larger than the axial length of a tunnel lining segment;

said main thrust rams means being extendable rearwadly in unison a distance which is substantially $1/x$ of the stroke of the auxiliary thrust rams, where $x$ is the number of groups of auxiliary thrust rams; and said groups of auxiliary thrust rams being progressively offset an amount substantially equal to the stroke of said main thrust ram means, whereby one group of the auxiliary thrust rams means can be retracted and tunnel lining installed between them and a previously installed portion of tunnel lining while the other groups of auxiliary thrust rams are extended against previously installed portions of the tunnel lining and the main thrust rams are being used for moving the front shield relative to the rear shield.

2. The improvement of claim 1, comprising two groups of auxiliary thrust ram means.

3. The improvement of claim 2, wherein a first set of auxiliary thrust rams are mounted in the upper semicircular portion of the frame and a second set of auxiliary thrust rams are mounted in the lower semicircular portion of the frame.

4. The improvement of claim 1, wherein said rear shield includes gripper means forwardly of the tail section, for gripping the tunnel wall to anchor the rear shield against movement, and torque transfer means are provided between the two shields.

5. The improvement of claim 1, wherein said main thrust ram means are double-acting hydraulic linear motors connected at one end to the front shield and at the other to the rear shield, and are employed for reacting rearwardly against the rear shield to push the front shield forwardly and also to pull the rear shield forwardly to the front shield.

* * * * *

UNITED STATES PATENT OFFICE

CERTIFICATE OF CORRECTION

Patent No. 3,967,463 Dated July 6, 1976

Inventor(s) Carlo Grandori

It is certified that error appears in the above-identified patent and that said Letters Patent are hereby corrected as shown below:

Front page, Abstract, "lx" should be -- 1/x -- .

Column 2, line 68, "vx" should be -- 1/x -- .

Column 7, lines 39 and 40, "chamber lower" should be -- lower chamber -- .

Claim 1, Column 10, line 4, after "end-to-end" insert -- related -- .

Signed and Sealed this

Nineteenth Day of October 1976

[SEAL]

*Attest:*

RUTH C. MASON
*Attesting Officer*

C. MARSHALL DANN
*Commissioner of Patents and Trademarks*